US010312565B1

(12) United States Patent
Aster

(10) Patent No.: US 10,312,565 B1
(45) Date of Patent: Jun. 4, 2019

(54) MICROWAVE POWER DIVIDER/COMBINER DEVICES, MICROWAVE POWER DIVIDER/COMBINER BANDPASS FILTERS, AND METHODS OF THERMALLY COOLING A CABLE RUN

(71) Applicant: David B. Aster, Spokane Valley, WA (US)

(72) Inventor: David B. Aster, Spokane Valley, WA (US)

( * ) Notice: Subject to any disclaimer, the term of this patent is extended or adjusted under 35 U.S.C. 154(b) by 7 days.

(21) Appl. No.: 15/923,515

(22) Filed: Mar. 16, 2018

Related U.S. Application Data

(63) Continuation-in-part of application No. 15/582,533, filed on Apr. 28, 2017, now Pat. No. 9,947,986, which is a continuation-in-part of application No. 15/043,570, filed on Feb. 14, 2016, now Pat. No. 9,673,503, and a continuation-in-part of application No. 15/078,086, filed on Mar. 23, 2016, now Pat. No. 9,793,591, application No. 15/923,515, which is a continuation-in-part of application No. 15/614,572, filed on Jun. 5, 2017, now Pat. No. 9,960,469, which is a continuation-in-part of application No. 15/043,570, which is a continuation-in-part of application No. 15/078,086.

(Continued)

(51) Int. Cl.

| | |
|---|---|
| ***H01P 1/30*** | (2006.01) |
| ***H01P 3/06*** | (2006.01) |
| ***H01P 1/213*** | (2006.01) |
| ***H01P 11/00*** | (2006.01) |

(52) U.S. Cl.
CPC ..... *H01P 1/30* (2013.01); *H01P 1/2133* (2013.01); *H01P 3/06* (2013.01); *H01P 11/005* (2013.01); *H01P 11/007* (2013.01)

(58) Field of Classification Search
CPC .. H01P 1/30; H01P 1/2133; H01P 3/06; H01P 11/005; H01P 11/007
USPC ..... 333/193
See application file for complete search history.

(56) References Cited

U.S. PATENT DOCUMENTS 2,946,965 A 7/1960 Albanese
3,931,587 A 1/1976 Harp et al.
(Continued)

OTHER PUBLICATIONS

Kenneth J. Russell, 'Microwave power combining techniques,' IEEE Transactions on Microwave Theory and Techniques, May 1979, pp. 472-478.

(Continued)

*Primary Examiner* — Robert J Pascal
*Assistant Examiner* — Kimberly E Glenn
(74) *Attorney, Agent, or Firm* — Malhotra Law Firm, PLLC; Deepak Malhotra

(57) ABSTRACT

A method of thermally cooling a microwave coaxial cable run includes inserting in the cable run a bandpass filter, the bandpass filter including a power divider having an input RF connector defining a front end and the power divider having an output, the bandpass filter including a power combiner having an input coupled to the output of the power divider and the power combiner having an output RF connector defining a back end, and the bandpass filter having a heat sink mechanically secured between the power divider and the power combiner. Other methods and systems are also provided.

20 Claims, 15 Drawing Sheets

Section 1 - 1

Related U.S. Application Data

(60) Provisional application No. 62/140,390, filed on Mar. 30, 2015.

(56) References Cited

U.S. PATENT DOCUMENTS

| | | | |
|---|---|---|---|
| 4,032,865 | A | 6/1977 | Harp et al. |
| 4,152,680 | A | 5/1979 | Harrison |
| 4,188,590 | A | 2/1980 | Harp et al. |
| 4,238,747 | A | 12/1980 | Harp et al. |
| 4,266,208 | A | 5/1981 | Cornish |
| 4,453,139 | A | 6/1984 | Labaar |
| 4,598,254 | A | 7/1986 | Saito et al. |
| 4,694,260 | A | 9/1987 | Argintaru et al. |
| 4,700,145 | A | 10/1987 | Yelland |
| 4,835,496 | A | 5/1989 | Schellenberg et al. |
| 5,389,890 | A | 2/1995 | Burrage |
| 5,644,272 | A | 7/1997 | Dabrowski |
| 5,777,527 | A | 7/1998 | Sanders |
| 5,784,033 | A | 7/1998 | Boldissar, Jr. |
| 5,847,625 | A | 12/1998 | Gillette |
| 6,005,450 | A | 12/1999 | Schmidt et al. |
| 6,018,277 | A | 1/2000 | Vaisanen |
| 6,919,776 | B1 | 7/2005 | Mobius et al. |
| 7,102,459 | B1 | 9/2006 | Arnold et al. |
| 7,215,218 | B2 | 5/2007 | Burns et al. |
| 7,397,328 | B2 | 7/2008 | Yasuda et al. |
| 7,468,640 | B2 | 12/2008 | Nosaka |
| 7,479,850 | B2 | 1/2009 | Kearns et al. |
| 8,508,313 | B1 | 8/2013 | Aster |
| 9,065,163 | B1 | 6/2015 | Wu et al. |
| 2013/0335162 | A1 | 12/2013 | Sun |
| 2017/0179598 | A1* | 6/2017 | Kitt ..... H01P 5/12 |

OTHER PUBLICATIONS

Clayton R. Paul, Analysis of Multiconductor Transmission Lines, John Wiley & Sons, New York, New York, 1994, pp. 219-222.

G. C. Temes and S. K. Mitra, Modern Filter Theory and Design, John Wiley & Sons, New York, New York, 1973, pp. 276-284.

G. Matthaei, L. Young, E.M.T. Jones, Microwave Filters, Impedance-matching Networks, and Coupling Structures, Artech House Books, Dedham, MA, pp. 585-595.

G. C. Temes and S. K. Mitra, Modern Filter Theory and Design, John Wiley & Sons, New York, New York, pp. 306-308, 1973.

G. Matthaei, L. Young, E.M.T. Jones, Microwave Filters, Impedance-matching Networks, and Coupling Structures, Artech House Books, Dedham, MA, pp. 595-599.

"Choosing the Best Power Divider for the Task of Signal Combining" retrieved from: http://www.microlab_fxr.com/resource-library?brand=Microlab&go=application_notes, downloaded and printed on Feb. 6, 2016 (6 pages).

"Reactive vs. Wilkinson Splitters" retrieved from: http://www.microlab.fxr.com/resource-library?brand=Microlab&go=application_notes, downloaded and printed on Feb. 6, 2016 (2 pages).

"Dividers & Combiners" retrieved from: http://www.microlab.fxr.com/resource-library?brand=Microlab&go=application_notes, downloaded and printed on Feb. 6, 2016 (4 pages).

G. Matthaei, L. Young, E.M.T. Jones, Microwave Filters, Impedance-matching Networks, and Coupling Structures, Artech House Books, Dedham, MA, p. 220.

Wilkinson, Ernest J., An N-Way Hybrid Power Divider, Jan. 1960, pp. 116-118, IRE Transactions on Microwave Theory and Techniques.

Horton, M.G., and Wenzel, R.J., General Theory and Design of Optimum Quarter-Wave TEM Filters, May 1965, pp. 316-327, IEEE Transactions on Microwave Theory and Techniques.

First Office Action, dated Jul. 5, 2016, in U.S. Appl. No. 15/043,570, invented by the inventor hereof.

Second Office Action, dated Nov. 17, 2016, in U.S. Appl. No. 15/043,570, invented by the inventor hereof.

Electronics Research, Inc., Installation Instructions II2302, EIA Flange Adapters for Rigid Transmission Lines.

Matthaei, Young, and Jones, Microwave Filters, Impedance-Matching Networks, and Coupling Structures, 1980, p. 302, Artech House Books.

Patzelt and Arndt, Double-Plane Steps in Rectangular Waveguides and their Application for Transformers, Irises, and Filters, pp. 772-776, May 5 1982, IEEE Transactions on Microwave Theory and Techniques.

Whinnery, Jamieson, and Robbins, Coaxial-Line Discontinuities, p. 695, Nov. 1944, Proceedings of the I.R.E.

Semi-Flexible Air Dielectric Coaxial Cables and Connectors, 50 Ohms, EIA Standard RS-258, Mar. 1962, Table 1 and pp. 5-6.

First Office Action, dated Jul. 11, 2017, in U.S. Appl. No. 15/493,591, invented by the inventor hereof.

First Office Action, dated Jul. 14, 2016, in U.S. Appl. No. 15/493,074, invented by the inventor hereof.

First Office Action, dated Jul. 20, 2017, in U.S. Appl. No. 15/078,086, invented by the inventor hereof.

First Office Action, dated Dec. 29, 2017, in U.S. Appl. No. 15/614,572, invented by the inventor hereof.

Wenzel, the Modern Network Theory Approach to Microwave Filter Design, IEEE Transactions on Electromagnetic Compatibifity, pp. 196-209, Jun. 1, 1968, vol. EMC-10, No. 2.

Levy and Whiteley, Synthesis of Distributed Elliptic-Function Filters from Lumped-Constant Prototypes, IEEE Transactions on Microwave Theory and Techniques, pp. 506-517, Nov. 1966, vol. MTT-14, No. 11.

* cited by examiner

Section 1 - 1
100
101
102
103
104
105
106
107
108
108c
109
110
111
112
113
114
115
116
117
118
119
120
121
122
123
124
125
126
127
200
SC1
SC2
3
4

Section 3 - 3

Section 4 - 4

$N_S = 3$:

$Y_{10}^{(1)} = Y_{10}^{(2)} = .00333$ mho $Y_{20}^{(1)} = Y_{20}^{(2)} = .00904$ mho $Y_{12}^{(1)} = Y_{12}^{(2)} = -.01401$ mho C11 = 1.5112 E-10 Farads/m
C12 = C13 = C14 = -4.6678 E-11 Farads/m
C22 = C33 = C44 = 7.8600 E-11 Farads/m
C23 = C24 = C34 = -8.7995 E-13 Farads/m $$\underline{\underline{Y}} = v\,\underline{\underline{C}} = \begin{bmatrix} 0.04530 & -0.01399 & -0.01399 & -0.01399 \\ -0.01399 & 0.02356 & -0.00026 & -0.00026 \\ -0.01399 & -0.00026 & 0.02356 & -0.00026 \\ -0.01399 & -0.00026 & -0.00026 & 0.02356 \end{bmatrix}$$

$$Y_{10} = 0.00332 \text{ mho} = Y_{11} + N_S Y_{12}$$

$$Y_{20} = 0.00904 \text{ mho} = Y_{22} + Y_{12} + \sum_{p=3}^{N_s+1} Y_{2P}$$

MICROWAVE POWER DIVIDER/COMBINER DEVICES, MICROWAVE POWER DIVIDER/COMBINER BANDPASS FILTERS, AND METHODS OF THERMALLY COOLING A CABLE RUN

CROSS REFERENCE TO RELATED APPLICATIONS

This is a continuation-in-part of U.S. patent application Ser. No. 15/582,533, filed Apr. 28, 2017, which is a continuation-in-part of U.S. patent application Ser. No. 15/043,570, filed Feb. 14, 2016 (now U.S. Pat. No. 9,673,503) and a continuation-in-part of U.S. patent application Ser. No. 15/078,086, filed Mar. 23, 2016 (now U.S. Pat. No. 9,793,591), both of which (Ser. No. 15/043,570 and Ser. No. 15/078,086) in turn claim priority to U.S. Provisional Patent Application Ser. No. 62/140,390, filed Mar. 30, 2015, all of which were invented by the inventor hereof and all of which are incorporated herein by reference.

This is also a continuation in part of U.S. patent application Ser. No. 15/614,572, filed Jun. 5, 2017, which is a continuation-in-part of U.S. patent application Ser. No. 15/043,570, filed Feb. 14, 2016 (now U.S. Pat. No. 9,673,503), and a continuation-in-part of U.S. patent application Ser. No. 15/078,086, filed Mar. 23, 2016 (now U.S. Pat. No. 9,793,591), both of which (Ser. No. 15/043,570 and Ser. No. 15/078,086) in turn claim priority to U.S. Provisional Patent Application Ser. No. 62/140,390, filed Mar. 30, 2015, all of which were invented by the inventor hereof and all of which are incorporated herein by reference.

TECHNICAL FIELD

The technical field includes microwave reactive power dividers and combiners, coaxial cable systems, microwave filters, and transmission methods and systems.

BACKGROUND

Communications and radar industries have an interest in microwave transmission coaxial cable systems where low-frequency and/or large bandwidth operation makes the use of rectangular or ridged waveguide impractical. Lengths of air-filled rigid coaxial cable are typically joined together using commercially available RF connectors which feature a center conductor support typically made, in part, of poly-tetrafluoroethylene (PTFE) or Teflon™ at the connector interface. This thermoplastic material is most often favored because its material properties include low dielectric loss, negligible water absorption, chemical inertness, and a −200° C. to +250° C. useful temperature range. However, Teflon's thermal conductivity is very poor and it cold flows under the combined effects of mechanical stress and temperature. Consequently, center conductor temperature rise due to conductor and dielectric dissipative losses severely limits the average amount of microwave power allowable on rigid cable using PTFE dielectric. This is because, for long lengths of rigid air-filled coax cable, the center conductor is cooled mainly by gaseous convective cooling within the cable interior, and less so by radial cooling through the dielectric supports at the RF connector interfaces. An example from the Andrew Broadcasting Catalogue 35 is their Type 561 Standard Rigid Coaxial Transmission Line (50 ohms) with EIA 1⅝ standard coupling flanges using inner connector Model 34660 with PTFE dielectric. At 800 MHz, inner connector at 102° C. (216° F.), ambient temperature 40° C. (104° F.), filled with dry air: this cable system is rated for only 5.19 kilowatts average power.

Another example of average power limitation due to the need to limit coax cable center conductor temperature is in the high-power klystron, klystrode, and broadband travelling wave tube (TWT) industry. Coaxial ceramic disk windows are sometimes used at the output port of these high-power amplifiers. The brazed-in ceramic maintains vacuum-tight integrity between ambient air pressure and the amplifier tube's evacuated interior, yet allows the passage of microwave power into the customer's coaxial transmission line. For high average power applications, one source of window ceramic failure occurs if too high a temperature gradient exists between the ceramic inner diameter and its outer perimeter. Stress cracking occurs in the ceramic window if the radial thermal gradient is too high.

Cooling a coax cable center conductor is also desirable for low-loss transmission of microwave signals. In this application, imagine a set of ground-based microwave antennas that collect a faint signal from a distant space probe, which must be communicated with as little loss as possible through respective phase length-matched coax cable transmission lines to a reactive-type power combiner.

SUMMARY

In consideration of these rather poor heat transfer mechanisms in conventional microwave transmission coaxial cable systems, a need exists for augmented conductive thermal cooling of broadcast communications and radar cable center conductors, thereby allowing higher average power limits.

In the high-power klystron, klystrode, and broadband travelling wave tube (TWT) applications, a need exists for augmented conductive cooling of high-power amplifier output coax center conductors, where the reduced ceramic window radial thermal gradient makes higher average power achievable.

In the microwave signal transmission application, the resistive loss of a coax cable copper center conductor drops an order of magnitude at liquid nitrogen temperature (77° K.) compared to its resistive loss at 300° K. room temperature. Even better, if the cable center conductor is made from high-temperature superconductor material, near-zero resistive loss of each satellite antenna signal through the coax cables is then possible. In this application, a need exists for conductive cooling of coax cable center conductors to liquid nitrogen temperatures, or below.

Therefore, some embodiments provide methods and apparatus for thermal cooling of microwave coaxial cable by way of a bandpass filter incorporating multiconductor transmission lines within the filter structure which allows conduction cooling of the center conductor.

Some embodiments provide a method of thermally cooling a microwave coaxial cable run, the method including inserting in the cable run a bandpass filter, the bandpass filter including a power divider having an input RF connector defining a front end and the power divider having an output, the bandpass filter including a power combiner having an input coupled to the output of the power divider and the power combiner having an output RF connector defining a back end, and the bandpass filter having a heat sink mechanically secured between the power divider and the power combiner.

Other embodiments provide a bandpass filter including a power divider having an input RF connector defining a front end and the power divider having an output, the bandpass filter including a power combiner having an input coupled to the output of the power divider and the power combiner having an output RF connector defining a back end, and the bandpass filter having a heat sink mechanically secured between the power divider and the power combiner.

Other embodiments provide a method of thermally cooling a microwave coaxial cable run, the method including inserting in the cable run a bandpass filter, the bandpass filter including a power divider having an input RF connector defining a front end and having a center contact, and the power divider having an output, the bandpass filter including a power combiner having an input coupled to the output of the power divider and the power combiner having an output RF connector defining a back end and having a center contact, the bandpass filter having a heat conductor plate between the power divider and the power combiner, the bandpass filter having a first center conductor portion, defining a first axis, coupled to the center contact of the input RF connector and extending to the heat conductor plate, the bandpass filter having a second center conductor portion, defining a second axis coincident with the first axis, coupled to the center pin of the output RF connector and extending to the heat conductor plate, and the heat conductor plate having a forward facing surface defining a short circuit to the first center conductor portion and having a rearward facing surface defining a short circuit to the second center conductor portion, the power divider further including a plurality of angularly spaced apart satellite conductors, extending parallel to the first axis, supported radially exterior of the first center conductor portion, the power combiner further including a plurality of angularly spaced apart satellite conductors, extending parallel to the second axis, supported radially exterior of the second center conductor portion, the power divider satellite conductors being coupled to respective power combiner satellite conductors interior of the apertures in the heat conductor plate, the power divider further having an annular conductive ring, with a center axis coincident with the first axis, passing through the power divider satellite conductors, and the power combiner further having an annular conductive ring, with a center axis coincident with the second axis, passing through the power combiner satellite conductors.

Other embodiments provide a bandpass filter including a power divider having an input RF connector defining a front end of the bandpass filter, the power divider having an output, the input RF connector having a center contact and an outer conductor; a power combiner having an input coupled to the output of the power divider and the power combiner having an output RF connector defining a back end of the bandpass filter, the output RF connector being axially aligned with the input RF connector, the output RF connector having a center contact and an outer conductor; a heat sink between the power divider and power combiner, the heat sink having a plurality of angularly spaced apertures; a power divider center conductor, coupled to the center contact of the input RF connector, defining a first axis, and extending from the input RF connector towards the heat sink, the power divider center conductor having a first portion, proximate the input RF connector, with a first diameter, and having a second portion, proximate the heat sink, with a second diameter larger than the first diameter; a power combiner center conductor, coupled to the center contact of the output RF connector, defining a second axis, and extending from the output RF connector towards the heat sink, the power combiner center conductor having a first portion, proximate the output RF connector, with a first diameter, and having a second portion, proximate the heat sink, with a second diameter larger than the first diameter, the heat sink having a forward facing surface defining a short circuit to the second portion of the power combiner center conductor, the heat sink having a rearward facing surface defining a short circuit to the second portion of the power combiner center conductor, and the heat sink defining a plurality of radial short circuit spokes between the apertures of the heat sink; a power divider ground structure coupled to the heat sink and having an inner annular surface; a power combiner ground structure coupled to heat sink and having an inner annular surface defining, with the inner surface of the power divider ground structure, a chamber exterior; a plurality of angularly spaced apart power divider satellite conductors extending parallel to the first axis, radially spaced from the power divider center conductor; a plurality of angularly spaced apart power combiner satellite conductors extending parallel to the second axis, radially spaced from the power combiner center conductor; and a plurality of connection bullets, the power divider satellite conductors being coupled to the power combiner satellite conductors with the connection bullets, the connection bullets being located interior of the apertures in the heat sink.

BRIEF DESCRIPTION OF THE VIEWS OF THE DRAWINGS

FIG. 2 is determined.

FIG. 2 is extracted.

DETAILED DESCRIPTION OF THE ILLUSTRATED EMBODIMENTS

Figure 1:
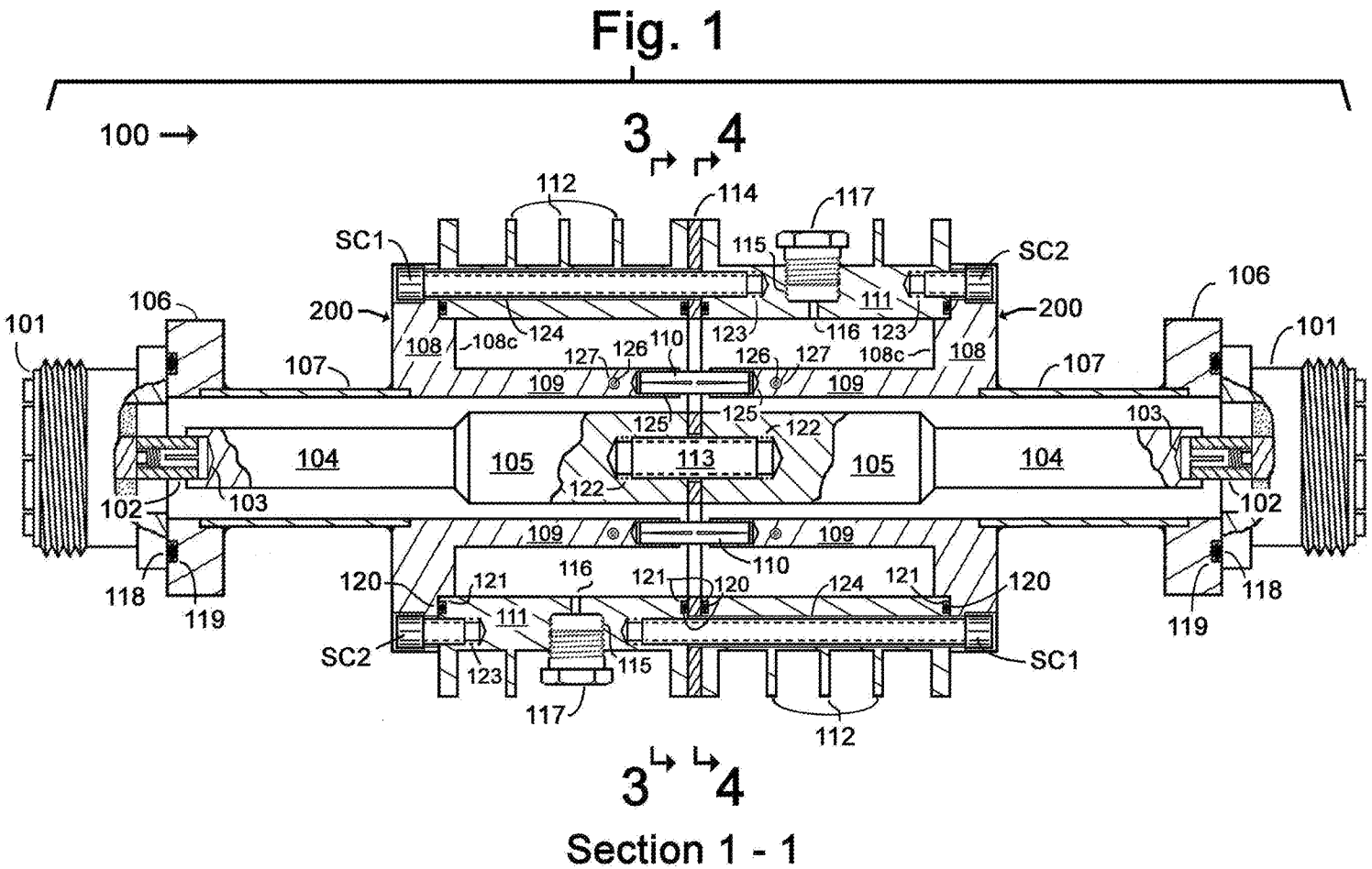
FIG. 1 is a side view of a bandpass filter in accordance with various embodiments, partly in section along line 1-1 of FIG. 3.

FIG. 1 shows a bandpass filter, in accordance with various embodiments. It shall hereinafter be referred to as bandpass filter 100.

The bandpass filter 100 (see FIGS. 1, 11, and 23, or FIGS. 2, 12 and 24) has identical opposed input and output portions which sandwich a thermally and electrically conducting center plate 114, to be described more fully below. The input portion functions as a power divider, while the output portion serves as a power combiner. For convenience, only the input power divider portion will be described, it being understood that the output power combiner portion is similarly described.

Figure 5:
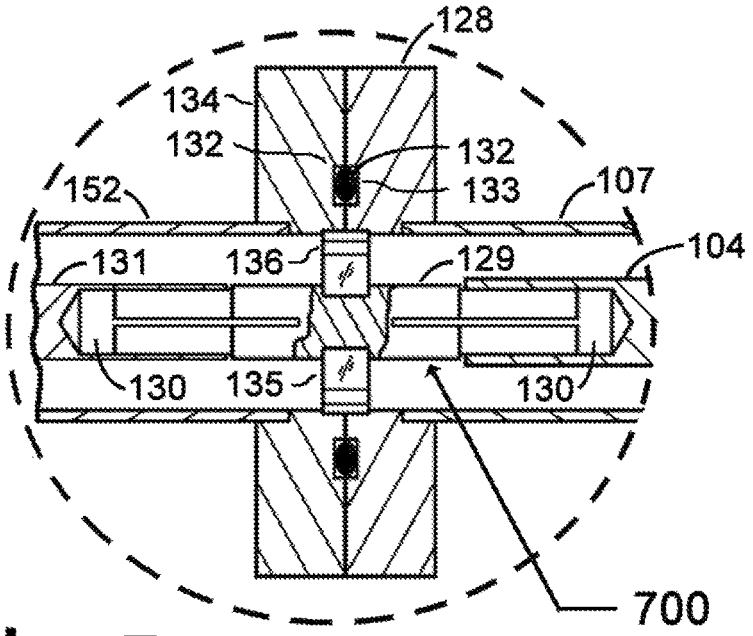
FIG. 5 is a partial cut-away view of the bandpass filter of FIG. 2 showing an input RF coax cable attachment using a standard inner connector.
Figure 6:
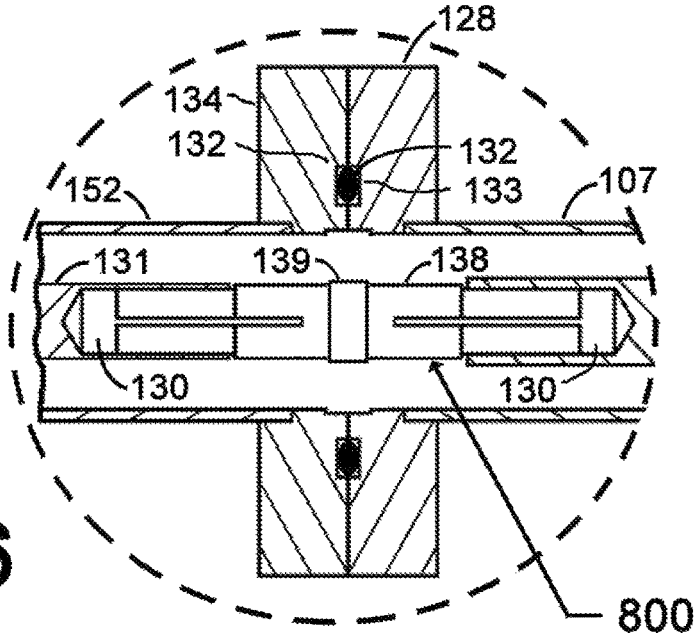
FIG. 6 is a partial cut-away view of the bandpass filter of FIG. 2 showing and input RF coax cable attachment using an inner connector featuring no PTFE dielectric.
Figure 7:
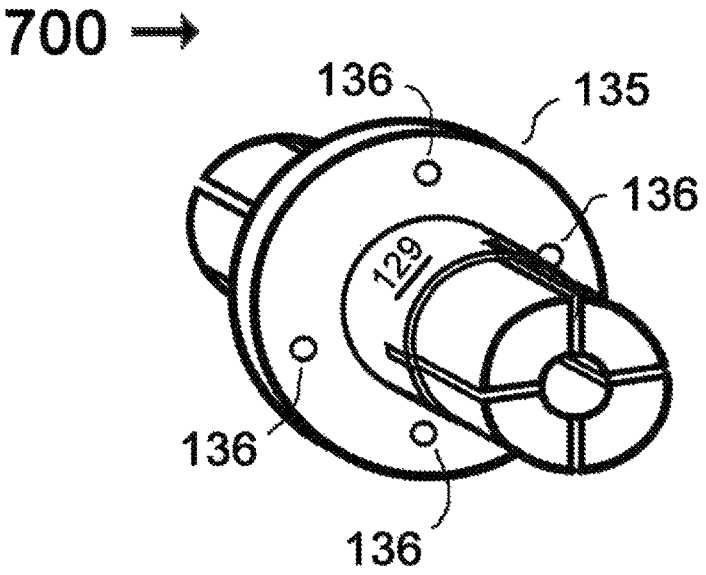
FIG. 7 is a perspective view of an inner connector as shown in FIG. 5.
Figure 8:
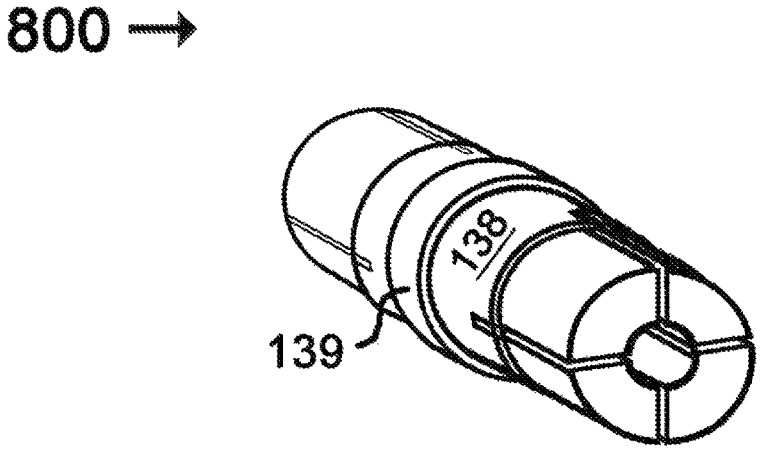
FIG. 8 is a perspective view of an inner connector as shown in FIG. 6.

In the illustrated embodiments shown in FIG. 1, the bandpass filter 100 has, at a forward end, an input flange 106, an input RF connector 101 which is 7-16 DIN female, and a center conductor bullet 102. Other embodiments are possible. For example, in the modified form of construction shown in FIGS. 2, 10, and 12, the input RF connector is ⅞ EIA having flange 128, and an inner connector assembly 700 (see FIGS. 5 and 7) comprised of an inner connector center conductor bullet 129 which engages bores 130 in both center conductor portion 104 and customer center conductor 131, and dielectric disk 135 each of which dimensionally conform to Electronics Industries Association Standard RS-258. In alternative embodiments, the through-holes 155 shown in flange 128 (see FIG. 10) may be threaded to so as to receive cap screws SC4 (see FIG. 24). An alternative embodiment is shown in FIGS. 6 and 8 where an inner connector assembly 800 consists of an inner connector 138 with a stepped diameter portion 139 which maintains 50 ohms impedance through the ⅞ EIA flanges 128 and 134. Other connector types, such as 4.1-9.5 DIN male or female, Type N male or female, 1⅝ EIA, SC or LC male or female, for example, could be employed.

Figure 4:
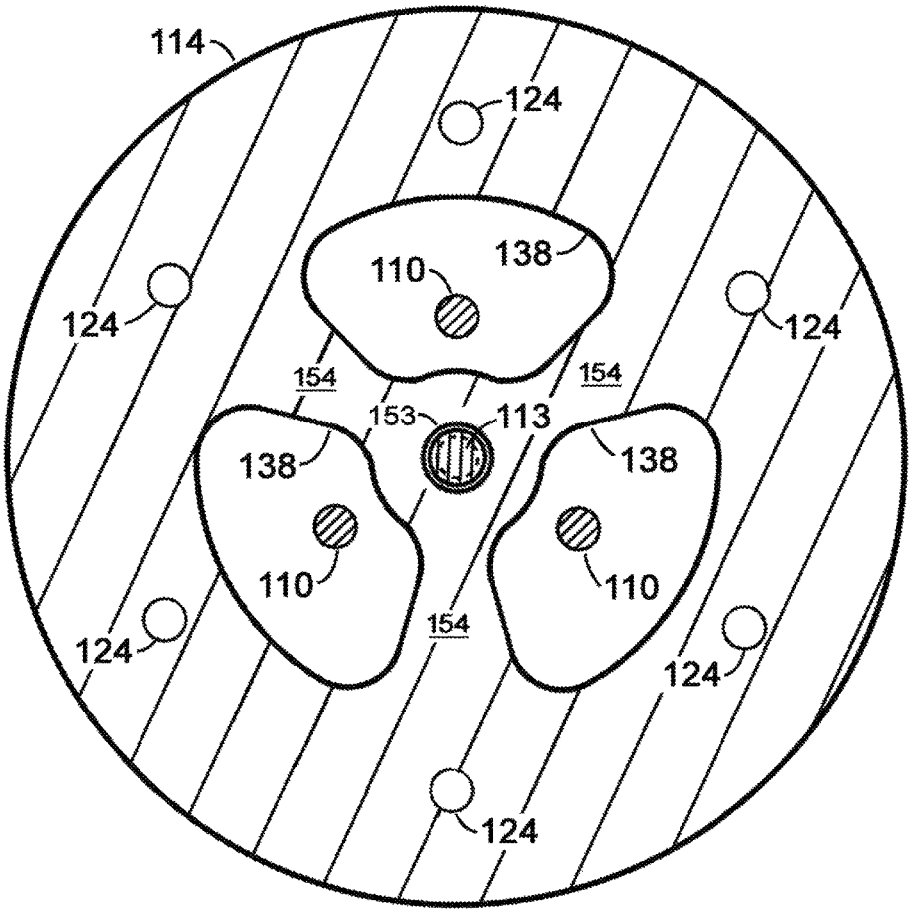
FIG. 4 is a sectional view taken along line 4-4 of FIG. 1 or FIG. 2.

In the illustrated embodiments, the bandpass filter 100 of FIG. 1 or 2, 10, 11 or 12 includes a center conductor including portions 104 and 105 which are electrically and mechanically connected to each other through a tapered step. The portions 104 and 105 are cylindrical in the illustrated embodiments, but other cross-section shapes are possible. The center plate 114 is electrically and thermally connected to portion 105 by a threaded rod or Allen screw 113 which spans a clearance bore 153 (see FIG. 4) in center plate 114 and which engages a threaded receiving bore 122 in conductor portion 105. Alternatively, to increase thermal heat transfer, conductor portions 105 may be soldered or brazed to center plate 114 in lieu of or in conjunction with threaded fastener 113. Center contact bullet 102 is received in bore 103 which is located and centered on-axis in the forward end of center conductor portion 104.

Figure 2:
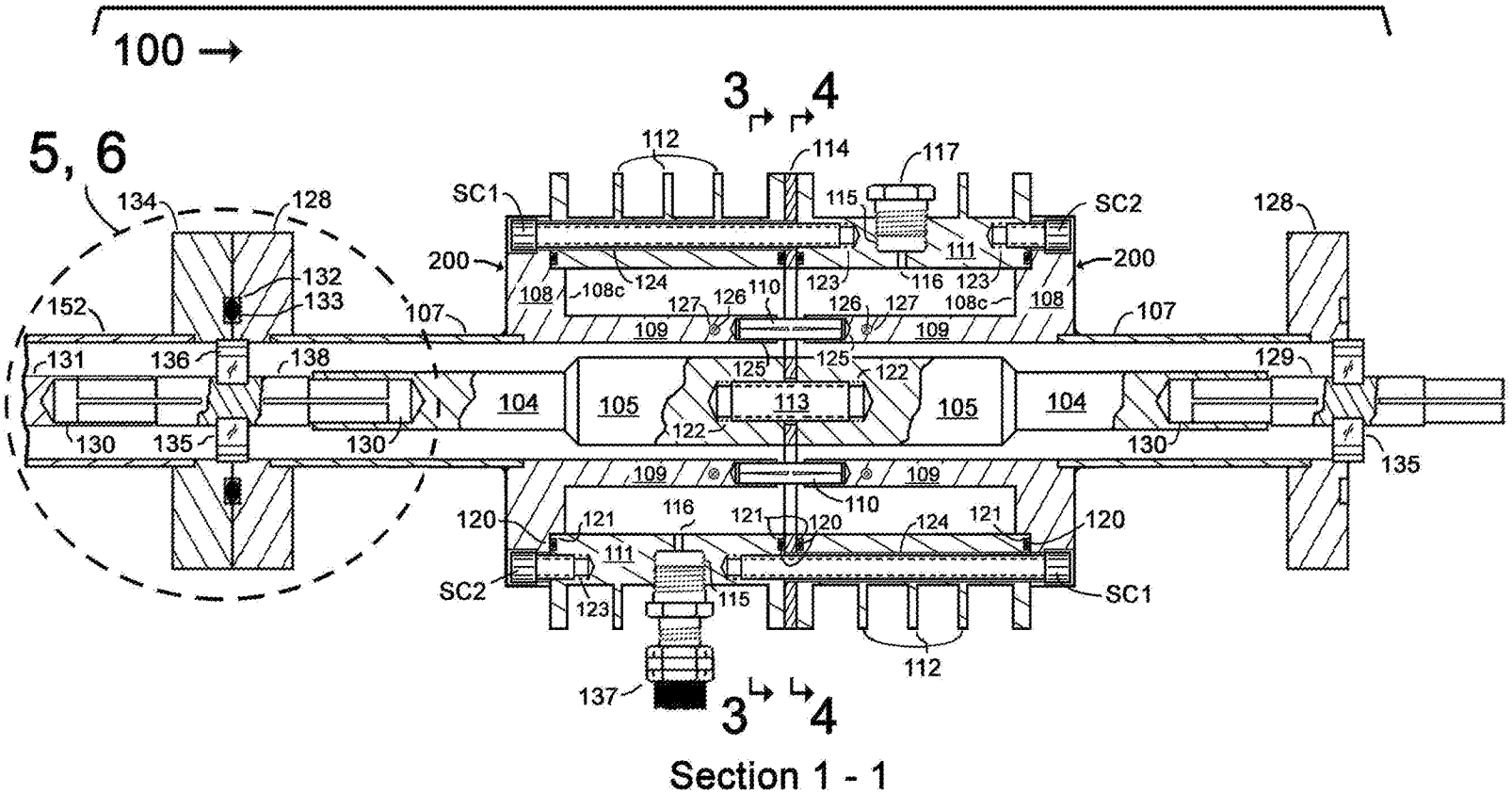
FIG. 2 is a side view of a bandpass filter in accordance with alternative embodiments, also showing one plug replaced with a pressure valve to allow the introduction of a gas.
Figure 3:
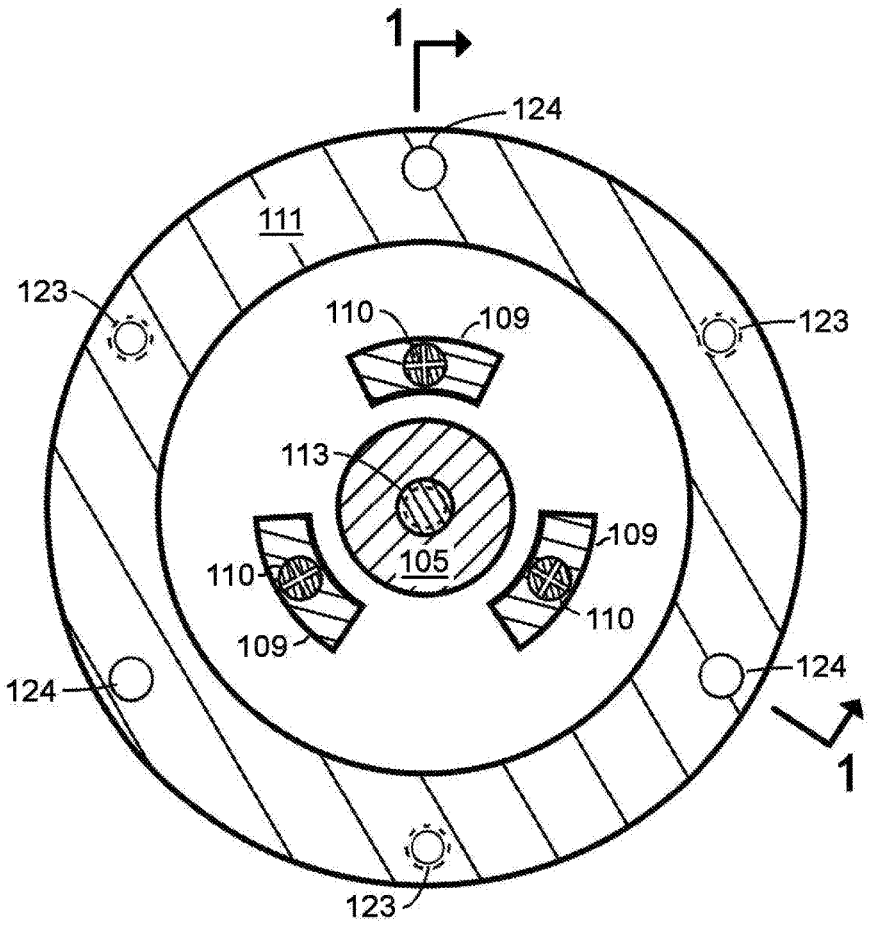
FIG. 3 is a sectional view taken along line 3-3 of FIG. 1 or FIG. 2.
Figure 9:
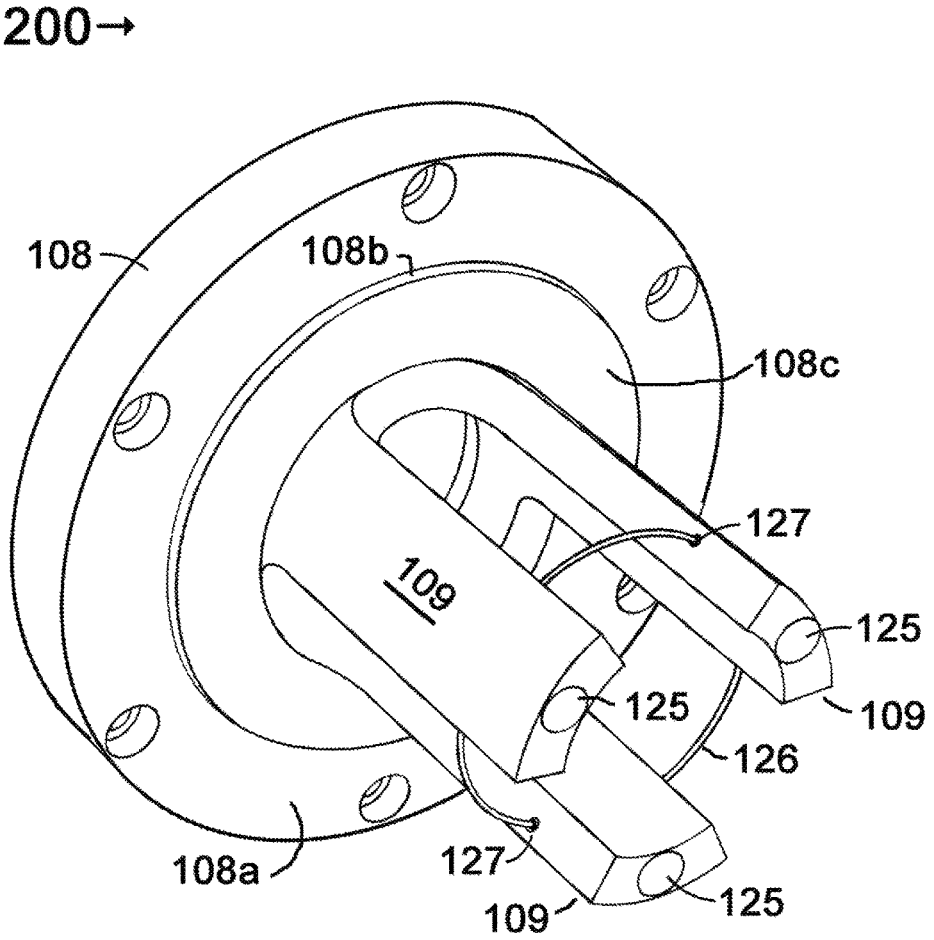
FIG. 9 is a perspective view of a conductor assembly as shown in FIG. 1
Figure 10:
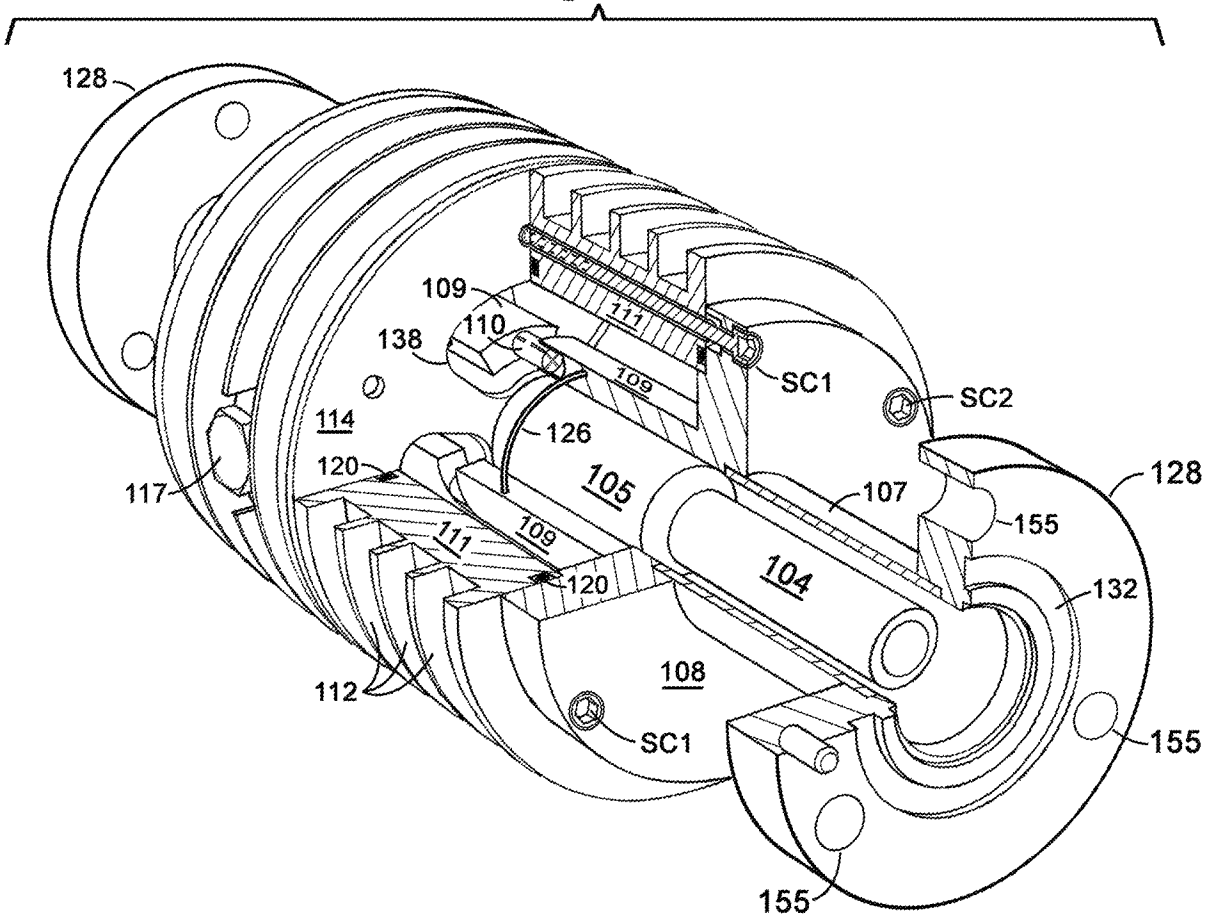
FIG. 10 is a perspective view showing the embodiments of the bandpass filter of FIG. 2, shown partly in section, that have an Electronic Industries Association (EIA) ⅞ flange input and output ports.
Figure 11:
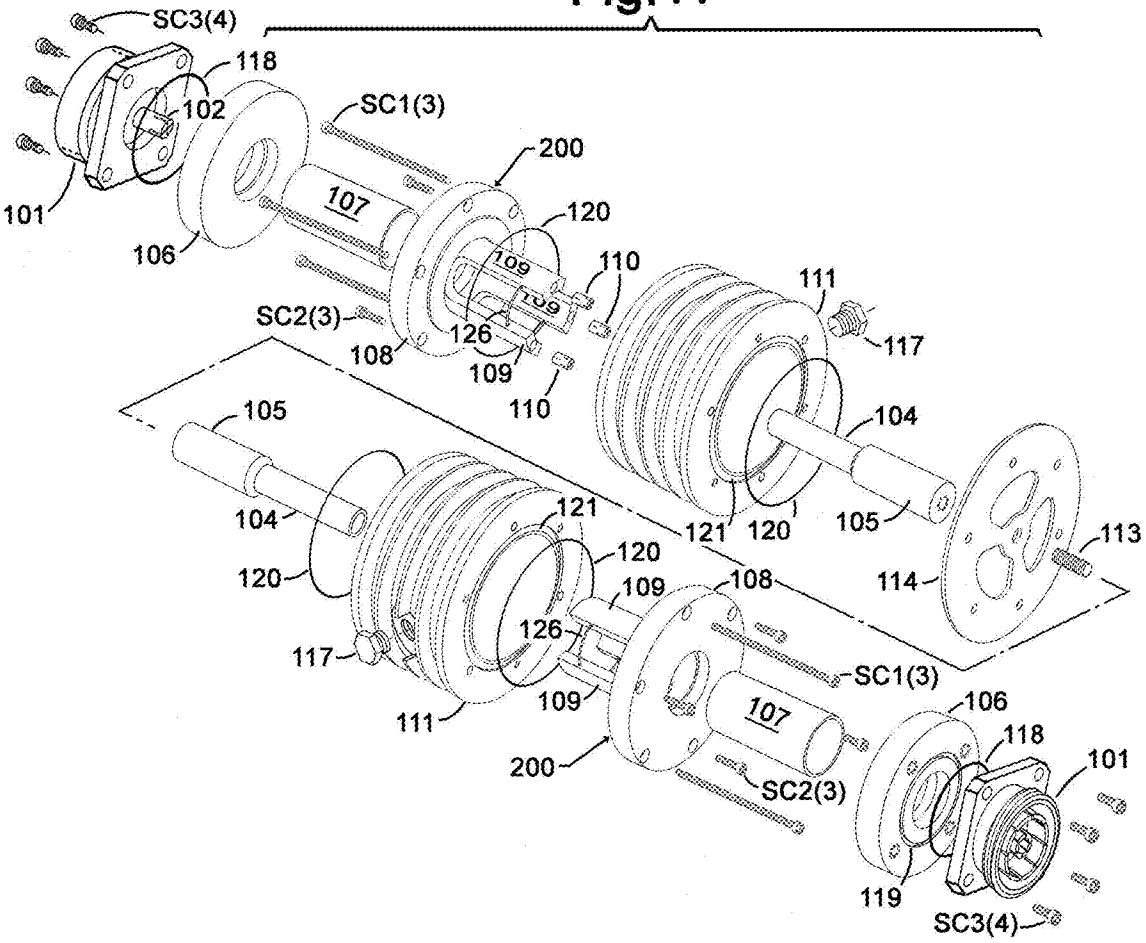
FIG. 11 is an exploded view of the bandpass filter as shown in FIG. 1.
Figure 12:
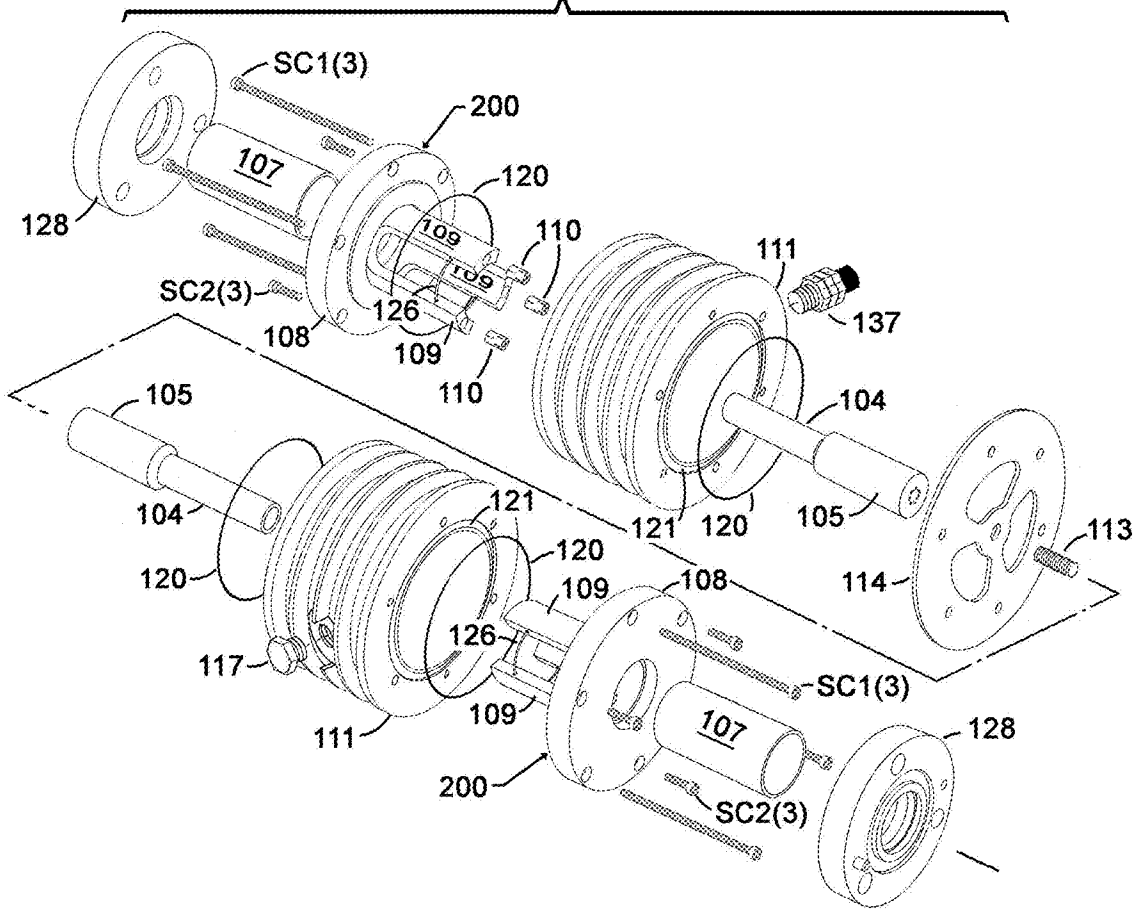
FIG. 12 is an exploded view of the bandpass filter as shown in FIG. 2.

Bandpass filter 100 includes a plurality of satellite conductors 109 defining, in the illustrated embodiments, the general shape of a slotted hollow cylinder (see FIG. 9 and exploded views FIG. 11 or 12). Other cross-section shapes are possible for each conductor 109, such as a circular cross-section, for example. In the illustrated embodiments (see FIGS. 3, 10), there is a plurality $N_S$ of such satellite conductors 109 uniformly spaced about the main center conductor portion 105, and positioned radially exterior of the portion 105. Respective divider output slotted contact bullets 110 are electrically connected with an outer end of one of the satellite conductors 109. FIG. 1 or 2 shows contact bullet 110 with its slotted end compression fit into receiving bore 125 located near the end of conductor 109. Further, the contact bullets 110 define respective axes that are parallel to an axis defined by conductor 105. The bandpass filter 100 further includes a sidewall or exterior sidewall ground conductor 111 and ground conductor 107.

In the illustrated embodiments, center plate 114 (see FIGS. 1, 2, 4, 10, and exploded views 11 or 12), provides 1) mechanical support for center conductor portions 105 and 104, 2) a thermal conduction path from conductor portion 105 to the sidewall ground 111 via conduction straps 154 (see FIG. 4), 3) a short circuit electrical conduction path from conductor portion 105 to sidewall ground 111 via the aforementioned conduction straps 154, and 4) a plurality $N_S$ apertures 138 which respectively serves as the outer conductor of a two-conductor transmission line with center conductor 110, there being a quantity $N_S$ such two-conductor transmission lines.

The bandpass filter 100 further includes an electrically conducting ring or wire 126 fed through bores 127 located near the end of each satellite conductor 109, and drilled or otherwise formed transverse to the main conductor portion 105 axis (see FIG. 1, 2, 9, 10, 11 or 12). The void remaining in bores 127 may be left empty or, alternatively filled, for example, with solder, electrically conductive epoxy, or brazing metal alloy. With regard to the power divider operating in concert with the combiner portion of bandpass filter 100, the conducting ring or wires 126 serve to prevent a half-wave resonance near the passband mid-band frequency $f_o$. This resonance is caused by an undesired multiconductor transmission line (MTL) mode where, at any axial position z along the MTL, this 'bad' mode creates unequal voltages on each satellite conductor, giving rise to a half-wave resonance near $f_o$. But the power divider conductive wire 126 enforces equal voltage potential at the axial z position where it makes contact with each power divider satellite conductor 109. Similarly, the power combiner conductive wire 126 enforces equal voltage potential at the axial z position where it makes contact with each power combiner satellite conductor 109. The wires 126 thereby encourage only the desired MTL mode (or eigenmode) which gives rise to equal power division (or combining) along each MTL.

The bandpass filter 100 further includes a flange 108 that is electrically and thermally conducting, in the illustrated embodiment. Satellite conductors 109 have respective inner ends that are electrically and thermally connected to the rearward face 108*c* of flange 108 (see FIGS. 1, 2, 9, and 10). In the illustrated embodiments, conductors 109 and flange 108 are shown as one piece, but in other embodiments conductors 108 and 109 are separate piece parts which may be joined together, for example, with screw fasteners, or by soldering, brazing, or welding. Furthermore, the rearward end of ground conductor 107 is electrically connected to the forward face of flange 108, to which it is mechanically joined by, for example, soldering, brazing, or welding (see FIGS. 1, 2, and 10). The forward surface of sidewall ground conductor 111 is electrically and thermally connected with surface 108*a* (see FIG. 9), and the rearward surface of 111 to the forward face of center plate 114, by means of cap screws SC1 (see FIG. 1, 2, 10, 11 or 12) which engage threaded bores 123 via through-holes 124 in both sidewall conductor 111 and center plate 114. Cap screws SC2 further secure electrical and thermal connection of the forward face of 111 to surface 108*a* by engaging threaded bores 123. The interior cylindrical surface of 111 engages hub surface 108*b*, providing substantially coincident alignment of the cylinder axis of sidewall ground conductor 111 and main conductor portion 105 axis. The forward end of ground conductor 107 electrically connects to the rearward face of input flange 106 to which it is mechanically joined by, for example, by soldering, brazing, or welding (see FIG. 1). In an alternative embodiment (see FIGS. 2 and 10), the forward end of ground conductor 107 electrically connects to the rearward face of input flange 128 to which it is mechanically joined by, for example, soldering, brazing, or welding (see FIG. 2).

The bandpass filter 100 further includes thermal cooling fins 112 (see FIG. 1, 2, or 10) which are shown as one piece with the exterior of sidewall ground conductor 111, but in alternative embodiments, may be separate pieces soldered, brazed, or welded to 111. Fins 112 provide cooling by various means including, but not limited to, convective or forced air cooling, fluid cooling using water, oil, liquefied gas cooling, or Peltier cooling junction methods.

In the illustrated embodiments, FIG. 1 shows the bandpass filter 100 further includes a circular O-ring groove 119 in the forward facing surface of input flange 106, and an O-ring 118 in the groove 119, so the O-ring 118 sits between and engages the input port flange 106 and the input connector 101. In the embodiments shown in FIG. 2, the forward surface of the ⅞ EIA flange 128 includes a circular O-ring half-groove 132 that engages a customer-supplied O-ring 133 which is simultaneously engaged by a corresponding half-groove within the customer coax ⅞ EIA mating flange 134. In the illustrated embodiments, the bandpass filter 100 further includes circular O-ring grooves 121 in the forward and rearward facing surfaces of ground conductor 111, and O-rings 120 in the grooves 121, so the O-rings 120 sits between and engages 1) the rearward face of flange 108 and 2) the forward face of the conductive plate 114.

It should be apparent that when an O-ring is provided in a groove of one component that faces another component, the groove could instead be provided in the other component. For example, the groove 119 could be provided in the flange of RF connector 101 instead of in the forward face of flange 106.

In the illustrated embodiments, the bandpass filter 100 further includes threaded bores or apertures 115 extending inwardly from the radially exterior cylindrical surface of ground conductor 111 (see FIG. 1 or 2). In the illustrated embodiments, the bandpass filter 100 further includes smaller diameter bores or apertures 116, aligned with the bores 115, and extending from the bores 115 to a gap between the sidewall conductor 111 and the satellite conductors 109. In the illustrated embodiments, there are two bores 115 and they are ⅛ NPT threaded bores. Other thread sizes are possible, but not limited to, for example, 3.0×0.6 metric threads. In the illustrated embodiments, the bandpass filter 100 further includes threaded sealing plugs 117 threadedly received in bores 115 (see FIGS. 1, and 2). One or both of the plugs 117 may be removed and replaced with a pressure valve such as, for example, a Schrader (e.g. bicycle tube) pressure valve so that dry air, dry Nitrogen, or arc suppression gas mixture may be introduced into the interior of bandpass filter 100 via the bores 116. Other types of pressure valves may be used, such as Presta or Dunlop valves, for example.

There are several reasons why the O-rings 118 and 120, threaded bores 115, and plugs 117 are advantageous. In FIG. 1, with both plugs 117 removed and replaced with Schrader valves 137 by the customer (see FIG. 23), dry Nitrogen or de-humidified air can be introduced through one Schrader valve and allowed to exit the other Schrader valve so as to purge moisture-laden air from the sealed bandpass filter interior. In the alternative form of construction shown in FIG. 2, the four small bores 136 in the ⅞ EIA inner connector 700 (see FIGS. 5, 7) allow dry Nitrogen or de-humidified air to flow through the length of a coax cable system, that includes the bandpass filter 100, to remove moisture that could otherwise condense and initiate RF loss or arcing within the cable system interior. The O-rings 118 and 120 of FIG. 1 (or the O-ring 120 and ⅞ EIA flange O-ring 133 of FIG. 2) also protect the cable/filter system interior from exterior moisture (cable jacket condensation or rainfall onto the cable/filter system leading to a broadcast or radar tower, for example), as well as preventing any leakage of the dry Nitrogen or de-humidified air flow.

Higher pressure within the bandpass filter 100 and the connecting cable interior increases the air dielectric breakdown strength. The entire system (see FIGS. 2 and 24) may then withstand higher-power microwave transmission, especially if high-pressure arc-suppression gas mixture is introduced, for example.

In other customer applications, extreme high-temperature operation and/or vacuum environment within the cable/filter system interior, it may not be feasible to use PTFE dielectric. FIGS. 2, 6, and 8 show a ⅞ EIA flange 128 using a modified inner conductor assembly 800, which does not use a PTFE support dielectric. Extremely high temperature operation or high vacuum interior may necessitate the use of annealed copper material for the O-rings 120 and 133, instead of materials such as, for example, Buna N or Viton. In alternative embodiments, O-rings 120 may be replaced with braze wire or braze paste, and the bandpass filter 100 piece parts brazed together to form a vacuum-tight assembly. Furthermore, threaded plugs 117 may be replaced by vacuum port threaded fittings 137.

Main conductor portions 104, 105 and satellite conductors 109 are substantially one quarter an electrical wavelength long at the passband mid-band frequency $f_O$.

Figure 16:
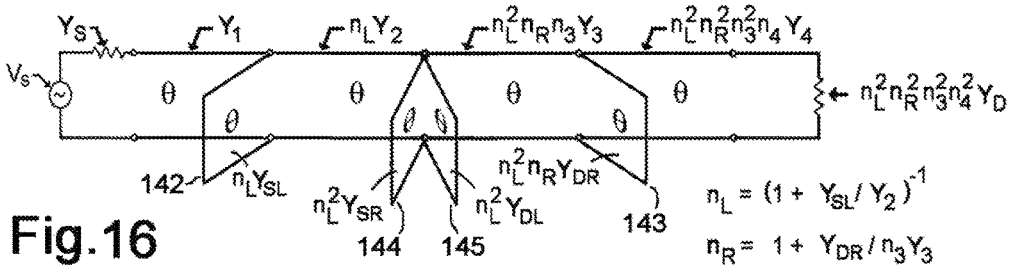
FIG. 16 is a third-modified electrical circuit which has substantially similar return loss performance to that of the electrical circuit shown in FIG. 13.
Figure 18:
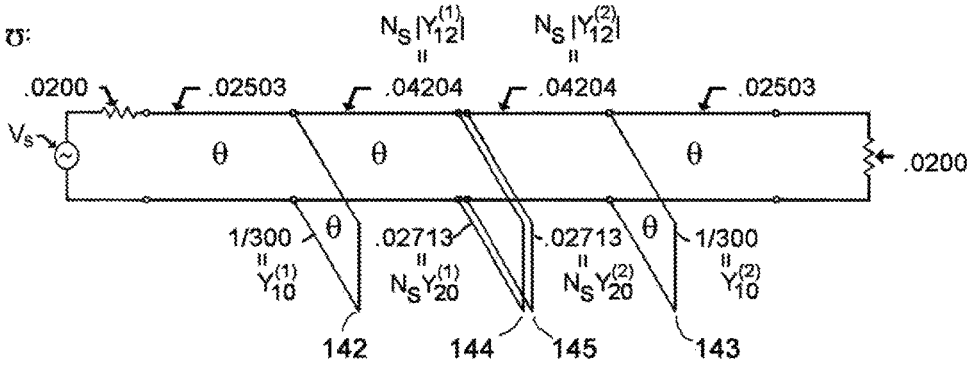
FIG. 18 shows circuit element values for the third-modified circuit of FIG. 16 based on the synthesized circuit values shown in FIG. 17, and from which the physical design of the passband filter of FIG. 1

Referring to the input-side power divider half (see FIGS. 1, 2, and 10), the portion 105 of the main center conductor, the quantity $N_S$=3 satellite conductors 109, and the inner cylindrical surface of sidewall ground conductor 111 define a multiconductor transmission line (MTL). In the illustrated embodiments, the MTL is preceded by a unit element (quarter-wave at frequency $f_O$) coaxial transmission line comprised of center conductor portion 104 and a cylindrical ground conductor 107. Referring to FIGS. 16 and 18, this corresponds to a unit element with characteristic admittance $Y_1$ which immediately follows the source admittance $Y_S$. The MTL is modeled collectively by the shorted shunt stub 142 with characteristic admittance $n_L Y_{SL}=Y_{10}^{(1)}$, a unit element with characteristic admittance $n_L Y_2=N_S|Y_{12}^{(1)}|$ and a shorted shunt stub 144 with characteristic admittance $n_L^2 Y_{SR}=N_S Y_{20}^{(1)}$ (comparing FIGS. 16 and 18). The rearward facing surface 108*c* serves as the short circuit for the shorted shunt stub 144 (see FIG. 1 or 2, 9, 16, and 18). The forward facing surface of the thermal conductive plate 114 serves as the short circuit for the shorted shunt stub 142 (see FIG. 1 or 2, 11 or 12, 16, and 18).

Referring to the output-side power combiner half (see FIGS. 1, 2, and 10), the portion 105 of the main center conductor, the quantity $N_S$=3 satellite conductors 109, and the inner cylindrical surface of sidewall ground conductor 111, again, define a multiconductor transmission line (MTL). In the illustrated embodiments, the MTL is followed by a unit element coaxial transmission line comprised of center conductor portion 104 and a cylindrical ground conductor 107. This corresponds to the unit element with characteristic admittance $n_L^2 n_R^2 n_3^2 n_4 Y_4$ which immediately precedes the load admittance $n_L^2 n_R^2 n_3^2 n_4^2 Y_D$, (see FIGS. 16 and 18). The MTL is modeled collectively by the shorted shunt stub 143 with characteristic admittance $n_L^2 n_R Y_{DR}=Y_{10}^{(2)}$, the unit element with characteristic admittance $n_L^2 n_R n_3 Y_3=N_S|Y_{12}^{(2)}|$ and the shorted shunt stub 145 with characteristic admittance $n_L^2 Y_{DL}=N_S Y_{20}^{(2)}$. The forward facing surface 108*c* serves as the short circuit for the shorted shunt stub 145 (see FIGS. 1, 9, 16, and 18). The rearward facing surface of the thermal conductive plate 114 serves as the short circuit for the shorted shunt stub 143 (see FIG. 1, 11 or 12, 16, and 18).

Figure 13:
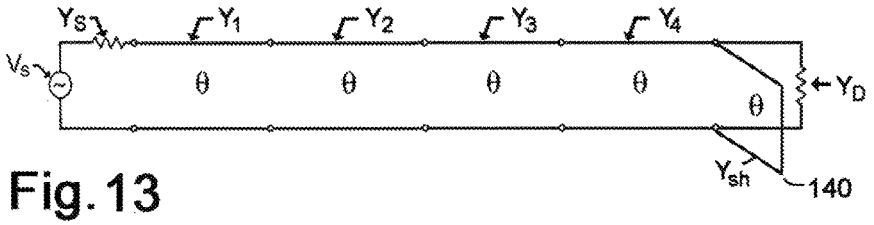
FIG. 13 is an initial basic electrical circuit, from which the return loss performance of the passband filter of FIG. 1
Figure 17:
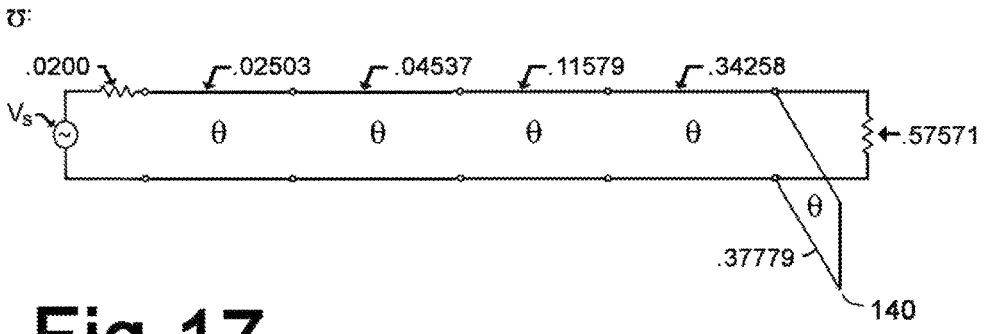
FIG. 17 shows synthesized circuit values for the initial basic electrical circuit of FIG. 13, which gives the calculated circuit performance depicted in the graph shown in FIG. 21, which represents the desired electrical performance of the bandpass filter of FIG. 1 or FIG. 2.
Figure 21:
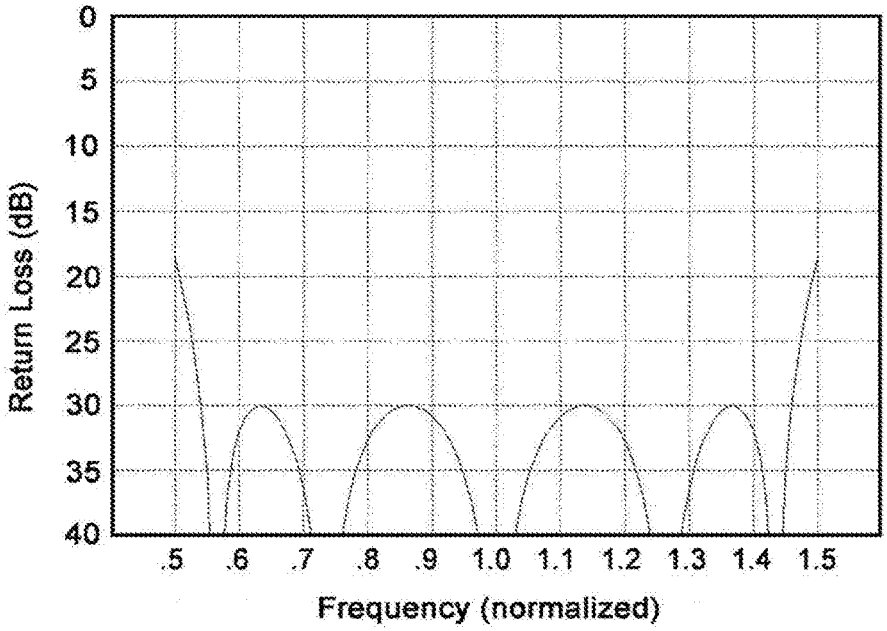
FIG. 21 is a graph showing typical predicted input port return loss vs. normalized frequency using the synthesized circuit quantities of FIG. 17.

Collectively, the input-side power divider and the output-side power combiner are electrically modeled, in a generalized form, as a passband filter equivalent circuit shown in FIG. 13. A passband is a portion of the frequency spectrum that allows transmission of a signal with a desired minimum insertion loss by means of some filtering device. In other words, a passband filter passes a band of frequencies to a defined passband insertion loss vs. frequency profile. Creating the desired filter passband performance and conversion to a symmetric divider-combiner physical structure is achieved by a three step process:

1) Given a source admittance quantity $Y_S$, bandwidth quantity equal to $\omega=2(f_2-f_1)/(f_2+f_1)$ where $f_1$ and $f_2$ are the lower and upper passband limits respectively, and the required return loss peaks within the passband for a Chebyshev-type passband return loss vs. frequency profile, calculate the unit element characteristic admittances $Y_1$, $Y_2$, $Y_3$, $Y_4$, the shorted shunt stub 140 characteristic admittance $Y_{SH}$, and load admittance $Y_D$ for the basic prototype circuit shown in FIG. 13. This may be accomplished, as one approach, using the design theory as described in M. C. Horton and R. J. Wenzel, "General theory and design of quarter-wave TEM filters," IEEE Trans. on Microwave Theory and Techniques, May 1965, pp. 316-327. As an example, input parameters for the return loss vs. frequency profile shown in FIG. 21 were: a) $\omega$=0.92, and b) a Chebyshev return loss profile having 30 dB return loss or better over the passband $f_1$ to $f_2$. The calculated values for the above admittances are shown in FIG. 17. Alternatively, bandpass filter 100 characteristic admittances $Y_1$, $Y_2$, $Y_3$, $Y_4$, and $Y_{SH}$ may be designed for other passband response profiles such as but not limited to, for example, maximally flat return loss vs. frequency.

Figure 14:
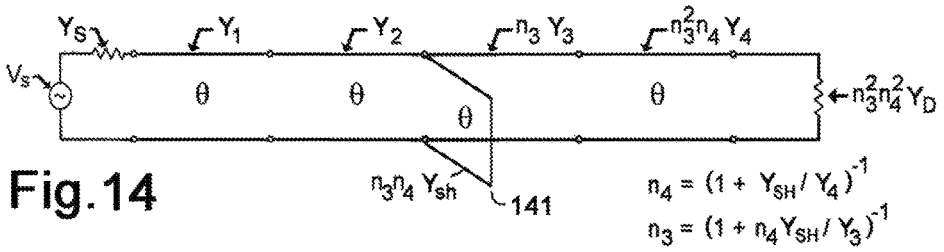
FIG. 14 is a first-modified electrical circuit which has substantially similar return loss performance to that of the electrical circuit shown in FIG. 13.

2) Form a symmetric prototype circuit by calculating Kuroda identity ideal transformer turns ratio quantities $n_4$, $n_3$ from equations shown in FIG. 14. This first-modified circuit transformation moves the shorted shunt stub 140 in FIG. 13 to the mid-circuit location shown in FIG. 14 as shorted shunt stub 141. The application of the Kuroda identities keeps the passband return loss vs. frequency profile unchanged. A partial listing of Kuroda identities can be found in Table 2 from Robert J. Wenzel, "The modern network theory approach to microwave filter design," IEEE Trans. on Electromagnetic Compatibility, Vol. EMC-10, No. 2, June 1968, pp. 196-209. A general formulation for interchanging a unit element and an arbitrary positive real two-port network may be found in R. Levy and I. Whiteley, "Synthesis of distributed elliptic-function filters from lumped-constant prototypes," IEEE Trans. on Microwave Theory and Techniques, Vol. MTT-14, No. 11, Nov. 1966, pp. 506-517.

Figure 15:
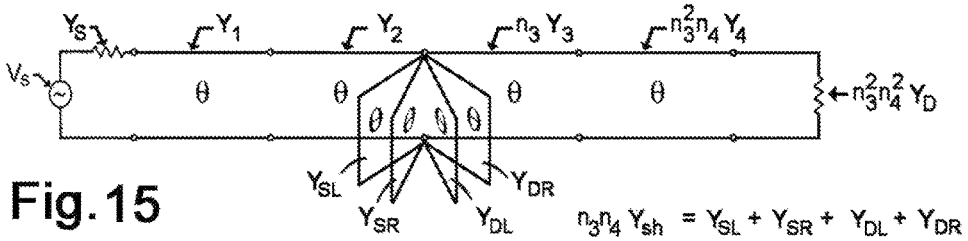
FIG. 15 is a second-modified electrical circuit which has substantially similar return loss performance to that of the electrical circuit shown in FIG. 13.

The characteristic admittance $n_3 n_4 Y_{SH}$ for shunt stub 141 (see FIG. 14) is then subdivided into four shorted shunt stubs in parallel having characteristic admittances $Y_{SL}$, $Y_{SR}$, $Y_{DL}$, and $Y_{DR}$ (see FIG. 15), thereby creating a second-modified circuit. Additional Kuroda identity applications gives a third-modified circuit with shorted shunt stubs 142, 143, 144 and 145 with respective characteristic admittances $n_L Y_{SL}$, $n_L^2 n_R Y_{DR}$, $n_L^2 Y_{SR}$, and $n_L^2 Y_{DL}$ along with ideal transformer turns ratios $n_L$ and $n_R$ as shown in FIG. 16. A symmetric prototype circuit results from setting $Y_S=n_L^2 n_R^2 n_3^2 n_4^2 Y_D$, $n_L Y_{SL}=n_L^2 n_R Y_{DR}$, $Y_1=n_L^2 n_R^2 n_3^2 n_4 Y_4$, $n_L Y_2=n_L^2 n_R n_3 Y_3$, and $n_L^2 Y_{SR}=n_L^2 Y_{DR}$. Continuing the example with the already-determined values for $Y_S$, $Y_1$, $Y_2$, $Y_3$, $Y_4$, $Y_{SH}$, and $Y_D$ (see FIG. 17, and resulting performance shown in FIG. 21), then a convenient numerical value may be chosen for the shunt stub 142 characteristic admittance: $n_L Y_{SL}=1/300\equiv\xi$ mho, thereby yielding $$n_4=1/(1+Y_{SH}/Y_4)=0.47556,$$

$$n_3=1/(1+n_4 Y_{SH}/Y_3)=0.391908,$$

$$n_L=1-\xi/Y_2=0.92653,$$

$$Y_{SL}=1/(1/\xi-1/Y_2)=0.0035977 \text{ mho},$$

$$Y_{DR}=n_3 Y_3 Y_{SL}/Y_2=0.0035984 \text{ mho},$$

$$Y_{SR}=Y_{DL}=[n_3/(1/Y_{SH}+1/Y_4)-Y_{SL}(1+n_3 Y_3/Y_2)]/2=0.031607 \text{ mho, and}$$

$$n_R=1+Y_{DR}/(n_3 Y_3)=1.07930,$$

from which the admittance values were obtained for the symmetric prototype circuit shown tabulated in FIG. 18. The basic prototype circuit of FIG. 17 and the symmetric prototype circuit in FIG. 18 both give substantially the same passband return loss performance (see FIG. 21).

Figures 19, 20:
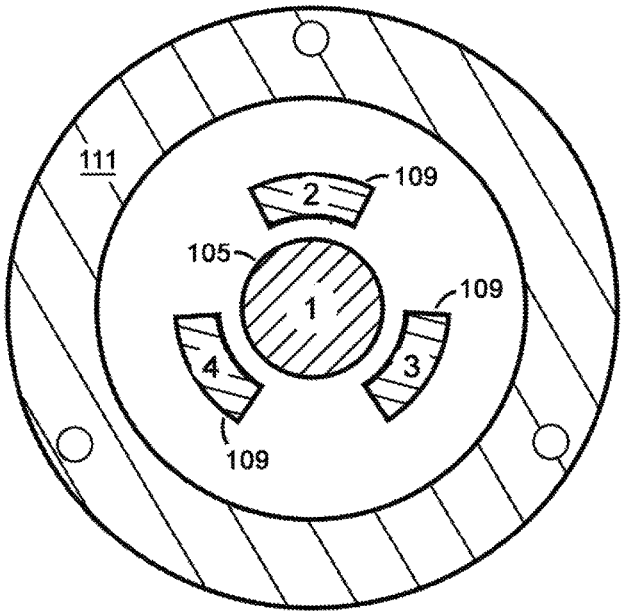
FIG. 19 is a sectional view similar to FIG. 3 taken along line 3-3 of FIG. 1 or FIG. 2, showing numbered labeling of the conductors.
FIG. 20 is a table showing an admittance matrix Y of the multiconductor transmission line shown in FIG. 19.

3) Find MTL cross-section dimensions that models closely the desired admittance matrix Y—derived values for $|Y_{12}|$, $Y_{10}$, and $Y_{20}$ tabulated for the symmetric prototype electrical circuit table shown in FIG. 18. For a chosen cross-section with $N_S$=3, and using the numbering of conductors as defined in FIG. 19, capacitance matrix values C11, C12, C22, and C23 were calculated. This analysis for a multiconductor transmission line cross section may be accomplished, as one approach, using the theory presented by C. Wei, R. Harrington, J. Mautz, and T. Sarkar, "Multiconductor transmission lines in multilayer dielectric media," IEEE Trans. on Microwave Theory and Techniques," Vol. MTT-32, pp. 439-450, April 1984. For a homogeneous dielectric MTL, its characteristic admittance matrix Y is proportional to the capacitance matrix C: $Y=v\cdot C$, where v is the velocity of light. Continuing the example, MTL cross section dimensions were adjusted in the software model until the tabulated characteristic admittance matrix Y of FIG. 20 was finally achieved. Extracted from matrix Y, the admittance quantities $Y_{12}=-0.01399$ mho, $Y_{10}=0.00332$ mho, and $Y_{20}=0.00904$ mho were close to the desired values $Y_{12}^{(1)}=Y_{12}^{(2)}=-0.01401$ mho, $Y_{10}^{(1)}=Y_{10}^{(2)}=0.00333$ mho, and $Y_{20}^{(1)}=Y_{20}^{(2)}=0.00904$ mho tabulated in FIG. 18. Here the superscript (1) refers to the input power divider MTL of bandpass filter 100, and superscript (2) corresponds to the output power combiner MTL of bandpass filter 100.

The thickness of center plate 114 (see FIG. 1, 2, 10, 11 or 12) is substantially 2% to 5% that of a quarter-wavelength at mid-band frequency $f_0$, thereby making it approximately equivalent, electrically, as the node junction where shorted shunt stubs 144 and 145 attach as shown in the equivalent circuit of FIG. 18.

The illustrated embodiments show three satellite conductors 109 for both the divider and combiner portions of bandpass filter 100, i.e., $N_S=3$ (see FIG. 3, 9, 11 or 12). However, other embodiments may show $N_S=1$, or $N_S=2$, or $N_S=4$ or more satellite conductors used in the divider and combiner MTLs. For the case $N_S=1$, equipotential wire 126 is not used (see FIG. 1, 2, 9, 10, 11, or 12).

Figure 22:
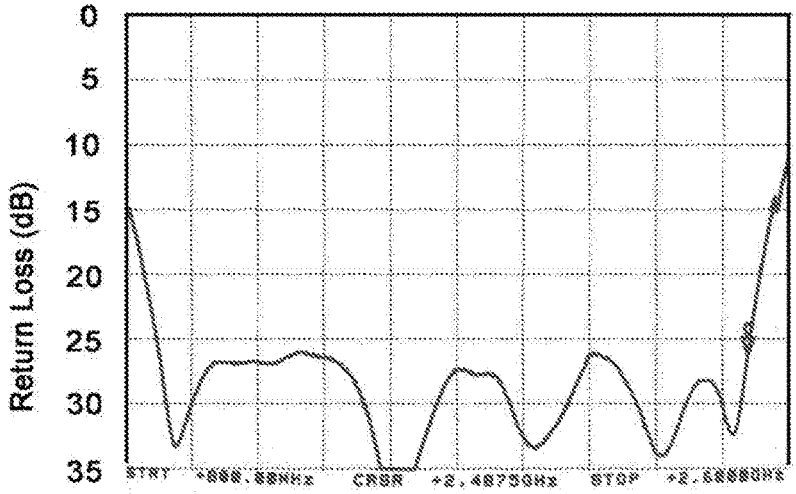
FIG. 22 shows measured performance of the passband filter of FIG. 10, for the embodiments of the bandpass filter of FIG. 2.
Figure 23:
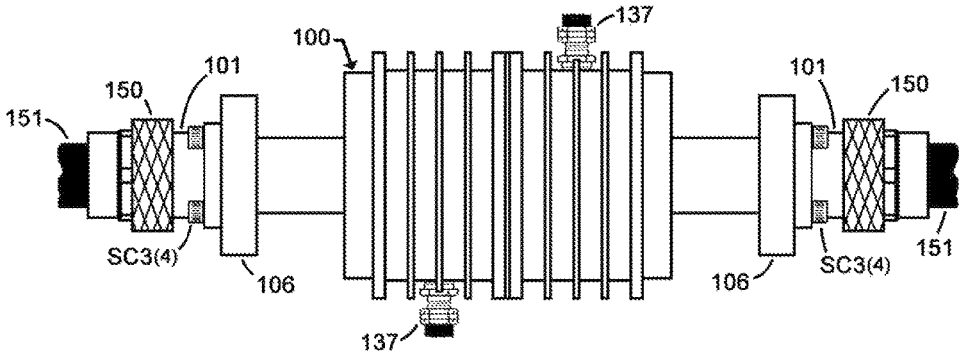
FIG. 23 shows a side view of a bandpass filter of FIG. 1 with cables attached, and with plugs replaced with pressure valves to allow the introduction of a gas.
Figure 24:
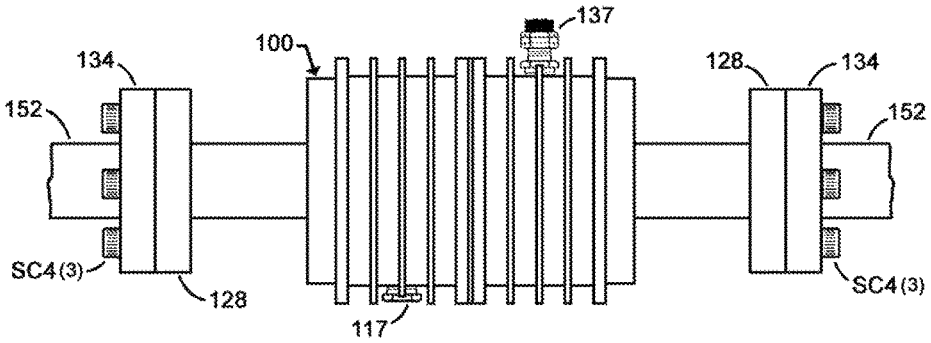
FIG. 24 shows an alternative method of construction, showing a side view of the bandpass filter of FIG. 2 with cables attached, and with one plug replaced with a pressure valve to allow the introduction of a gas.

FIG. 22 shows measured RF performance of the passband filter of FIG. 10. Return loss vs. frequency measured 26 dB or better over a $f_2/f_1=2.8$ passband frequency range, comparing fairly well with predicted performance shown in FIG. 21.

For applications requiring a much narrower passband $f_1$ to $f_2$, the unit element comprised of center conductor portion 104 and ground conductor 107 may be deleted from both power divider and power combiner portions of bandpass filter 100 leaving just the MTL sections. In this case, only characteristic admittances $Y_1$, $Y_2$, shorted shunt stub characteristic admittance $Y_{SH}$ and load admittance $Y_D$ are synthesized for the required narrow-band return loss vs. frequency profile, using the aforementioned Horton and Wenzel research paper, as one design approach. The shorted shunt stub section is then centered within a first-modified circuit using a Kuroda identity operation giving an ideal transformer turns ratio $n_2=(1+Y_{SH}/Y_2)^{-1}$. The centered shorted shunt stub is subdivided into four parallel shorted shunt stubs having characteristic admittances $Y_{SL}$, $Y_{SR}$, $Y_{DL}$, and $Y_{DR}$ giving a second-modified prototype circuit. Kuroda identity operations are next performed on the shorted shunt stubs with characteristic admittances $Y_{SL}$ and $Y_{DR}$ to giving transformer turns ratio quantities $n_L=(1+Y_{SL}/Y_1)^{-1}$ and $n_R=1+Y_{DR}/(n_2Y_2)$ giving a third-modified prototype circuit. This final prototype circuit is then comprised of a source admittance $Y_S$, followed by a shorted shunt stub with characteristic admittance $n_LY_{SL}$, followed by a unit element with characteristic admittance $n_LY_1$, followed by a shorted shunt stub with characteristic admittance $n_L^2Y_{SR}$ in parallel with a shorted shunt stub with characteristic admittance $n_L^2Y_{DL}$, followed by a unit element with characteristic admittance $n_L^2n_Rn_2Y_2$, followed by a shorted shunt stub with characteristic admittance $n_L^2n_RY_{DR}$, followed by a load admittance $n_L^2n_R^2n_2^2Y_D$. By enforcing a symmetric prototype circuit, and choosing a convenient numerical value to the quantity $\xi=n_LY_{SL}$, then $$Y_{SL}=1/(1/\xi-1/Y_1),$$

$$Y_{DR}=Y_{SL},$$

$$Y_{SR}=Y_{DL}=0.5/(1/Y_{SH}+1/Y_2)-Y_{SL}$$

yielding MTL admittance quantities:

$$Y_{10}^{(1)}=Y_{10}^{(2)}=n_LY_{SL},$$

$$Y_{20}^{(1)}=Y_{20}^{(2)}=n_L^2Y_{SR}/N_S,$$

$$Y_{12}^{(1)}=Y_{12}^{(2)}=-n_LY_1/N_S$$

for both power divider (superscript (1)) and power combiner (superscript (2)) MTLs. The number of satellite conductors $N_S$ may be chosen to be equal to 1, 2, 3 or more.

In the illustrated embodiments, input and output RF connectors of bandpass filter 100 are shown as 50 ohm connectors, and the prototype electrical circuit of FIG. 18 shows a corresponding 0.02 mho source and load admittance. In other embodiments, source and load impedances may have other values such as, for example, 75 ohms. In this case, bandpass filter 100 would use 75 ohm input and output RF connectors, with ensuing modified cross-section dimensions throughout the bandpass filter, based on the prototype electrical circuits shown in FIGS. 17 and 18 being scaled or modified accordingly.

Various electrically conductive materials could be employed for the conductive components for the bandpass filter 100. For example, in the illustrated embodiments, flange-satellite conductor assembly 200 comprised of flange 108 and satellite conductors 109 and flanges 106 or 128 (see FIG. 1 or 2, 9, 11 or 12) is fabricated from brass alloy, and ground conductor 107 from copper to facilitate soldering. The soldered assembly be gold or silver plated. Sidewall ground conductor 111 and cooling fins 112 are fabricated from 6061 aluminum as one piece, which may be alodined or electroless nickel followed by gold or silver plating. Center plate 114 is fabricated from 0.060" thick 110 half-hard copper plate which has good thermal conductivity, electrical conductivity, and mechanical strength. Electrically conducting ring or wire 126 may be a nickel-chrome alloy plated with gold or silver. Center conductor portions 104 and 105 were fabricated from 6061 aluminum, which may then be electroless nickel and then gold or silver plated. The aforementioned electroless nickel plating, and gold or silver plating be performed compliant with MILSPEC specifications. Center conductor portions 104 and 105 may also be partially filled with heat pipe thermally conductive material, such as for example, anisotropic pyrolytic carbon or anisotropic pyrolytic boron nitride. Alternatively, for cryo-temperature applications, center conductor portions 104 and 105 may be fabricated from a base layer of alloy or composite materials that is thermal expansion-matched to a plated or otherwise-cladded layer of high- or low-temperature superconducting material. Alternatively, other conductive materials may be employed for these components.

FIGS. 11 and 12 show an exploded views of the bandpass filter 100 of FIGS. 1 and 2, respectively, in accordance with various embodiments.

The main stepped diameter center conductor portions 104 and 105 (for both power divider and power combiner portions of bandpass filter 100) are fabricated as one piece, in the illustrated embodiments. Threaded rod 113 is 10-24×

⅝" long which captivates both portions 105 against both faces of center plate 114. On both power divider and power combiner sides of bandpass filter 100, each flange-satellite conductor assembly 200 is bolted to respective input-side and output-side sidewall conductors 110 with three 4-40×7/16" stainless steel socket head cap screws SC2. These bolted assemblies sandwich center plate 114 by means of six 4-40×2" stainless steel socket head cap screws SC1, using three from each end. In the embodiments shown in FIGS. 1 and 11, Input RF connector 101 is bolted to flange 106 using four 6-32×7/16" stainless steel socket head cap screws, on both input and output ends of bandpass filter 100. Other screw fastener types may be employed, made of other materials.

In compliance with the patent statutes, the subject matter disclosed herein has been described in language more or less specific as to structural and methodical features. However, the scope of protection sought is to be limited only by the following claims, given their broadest possible interpretations. Such claims are not to be limited by the specific features shown and described above, as the description above only discloses example embodiments.

The invention claimed is:

1. A method of thermally cooling a microwave coaxial cable run, the method comprising: inserting in the cable run a power divider and combiner device, the power divider and combiner device including a power divider having an input RF connector defining a front end and having a center contact, and the power divider having an output, the power divider and combiner device including a power combiner having an input coupled to the output of the power divider and the power combiner having an output RF connector defining a back end and having a center contact, the power divider and combiner device having a plate between the power divider and the power combiner, the power divider and combiner device having a first center conductor portion, defining a first axis, coupled to the center contact of the input RF connector and extending to the plate, the power divider and combiner device having a second center conductor portion, defining a second axis coincident with the first axis, coupled to the center contact of the output RF connector and extending to the plate, and the plate having a forward facing surface defining a short circuit to the first center conductor portion and having a rearward facing surface defining a short circuit to the second center conductor portion, the power divider further including a plurality of angularly spaced apart satellite conductors, extending parallel to the first axis, supported radially exterior of the first center conductor portion, the power combiner further including a plurality of angularly spaced apart satellite conductors, extending parallel to the second axis, supported radially exterior of the second center conductor portion, the power divider satellite conductors being coupled to respective power combiner satellite conductors interior of the apertures in the plate, the power divider further having an annular electrically conductive ring, with a center axis coincident with the first axis, passing through and coupled to the power divider satellite conductors, and the power combiner further having an annular electrically conductive ring, with a center axis coincident with the second axis, passing through and coupled to the power combiner satellite conductors.

2. A method in accordance with claim 1 wherein the plate includes a plurality of angularly spaced apart apertures, and defines a plurality of radial conduction straps between the apertures.

3. A method in accordance with claim 2 wherein the power divider and combiner device has an exterior electrically and thermally conductive ground structure coupled to the radial conduction straps, the exterior ground structure including a first portion extending forward of the plate and having a second portion extending rearward from the plate, the first exterior ground structure portion including an inner flange surface and a cylindrical inner surface defining a first chamber, and the second each exterior ground structure portion including an inner flange surface and a cylindrical inner surface defining a second chamber.

4. A method in accordance with claim 3 wherein the first portion exterior ground structure flange supports the power divider satellite conductors relative to the first center conductor portion and second portion exterior ground structure flange supports the power combiner satellite conductors relative to the second center conductor portion.

5. A method in accordance with claim 3 wherein the power divider and combiner device further comprises cooling fins thermally coupled to the exterior ground structure.

6. A method in accordance with claim 3 and further comprising the steps of providing a threaded bore in fluid communication with the chamber, and providing a threaded plug, complementary to the threaded bore, selectively plugging the threaded bore.

7. A method in accordance with claim 6 and further comprising configuring the power divider and combiner device, using O-ring seals, to retain a gas introduced via the threaded bore.

8. A method of thermally cooling a microwave coaxial cable run, the method comprising:

inserting in the cable run a bandpass filter, the bandpass filter including a power divider having an input RF connector defining a front end and the power divider having an output, the bandpass filter including a power combiner having an input coupled to the output of the power divider and the power combiner having an output RF connector defining a back end, and the bandpass filter having a heat sink mechanically secured between the power divider and the power combiner; wherein the input RF connector has a center contact, wherein the output RF connector has a center contact, and wherein the power divider and combiner device has a first center conductor portion coupled to the center contact of the input RF connector and extending to the heat sink, and wherein the power divider and combiner device has a second center conductor portion coupled to the center contact of the output RF connector and extending to the heat sink, wherein the heat sink is defined by a shorting plate that has a forward facing surface defining a short circuit to the first center conductor portion and has a rearward facing surface defining a short circuit to the second center conductor portion, and wherein the power divider and power combiner are electrically modeled to define a passband filter.

9. A method in accordance with claim 8 wherein the shorting plate includes a plurality of angularly spaced apart apertures, and a plurality of radial conduction straps between the apertures.

10. A method in accordance with claim 9 wherein the first center conductor portion defines a first axis, wherein the second center conductor portion defines a second axis coincident with the first axis, wherein the power divider further comprises a plurality of angularly spaced apart satellite conductors, supported by the first portion exterior ground structure flange, spaced radially exterior of the first center conductor portion and radially interior of the first portion exterior ground structure inner cylindrical surface, and wherein the power divider further comprises a conductive annular ring passing through the satellite conductors and having a center axis coincident with the first axis, wherein the power combiner further comprises a plurality of angularly spaced apart satellite conductors, supported by the second portion exterior ground structure flange, extending parallel to the first and second axes, spaced radially exterior of the center conductor and radially interior of the second portion exterior ground structure inner cylindrical surface, and wherein the power combiner further comprises a conductive annular ring passing through the power combiner satellite conductors and having a center axis coincident with the second axis, and wherein power divider satellite conductors are coupled to respective power combiner satellite conductors interior of the apertures in the shorting plate.

11. A method in accordance with claim 10 wherein the bandpass filter has first and second portion exterior ground structures coupled to the radial conduction straps, extending forward of and rearward of the shorting plate, and including inner cylindrical surfaces exterior of and spaced apart from the power divider and power combiner satellite conductors.

12. A method in accordance with claim 11 wherein the bandpass filter further includes connection bullets coupling the power divider satellite conductors to respective power combiner satellite conductors, and wherein, in operation, power from the power divider to the power combiner flows through a plurality of power transmission lines, each power transmission line being defined, at least in part, by one of the apertures through the shorting plate and one of the connection bullets.

13. A method in accordance with claim 12 wherein respective ones of the satellite conductors include a first portion extending forward of the shorting plate and a second portion extending rearward of the shorting plate, the respective first portions of the satellite conductors having rearward facing surfaces with bores therein, the respective second portions of the satellite conductors having forward facing surfaces with bores therein, the bandpass filter further comprising contact bullets coupling respective first portions of the satellite conductors with respective second portions of the satellite conductors.

14. A power divider and combiner device comprising:

a power divider having an input RF connector defining a front end of the power divider and combiner device, the power divider having an output, the input RF connector having a center contact and an outer conductor;

a power combiner having an input coupled to the output of the power divider and the power combiner having an output RF connector defining a back end of the power divider and combiner device, the output RF connector being axially aligned with the input RF connector, the output RF connector having a center contact and an outer conductor;

a heat sink between the power divider and power combiner, the heat sink having a plurality of angularly spaced apertures;

a power divider center conductor, coupled to the center contact of the input RF connector, defining a first axis, and extending from the input RF connector towards the heat sink, the power divider center conductor having a first portion, proximate the input RF connector, with a first diameter, and having a second portion, proximate the heat sink, with a second diameter larger than the first diameter;

a power combiner center conductor, coupled to the center contact of the output RF connector, defining a second axis, and extending from the output RF connector towards the heat sink, the power combiner center conductor having a first portion, proximate the output RF connector, with a first diameter, and having a second portion, proximate the heat sink, with a second diameter larger than the first diameter, the heat sink having a forward facing surface defining a short circuit to the second portion of the power combiner center conductor, the heat sink having a rearward facing surface defining a short circuit to the second portion of the power combiner center conductor, and the heat sink defining a plurality of radial conduction straps between the apertures of the heat sink;

a power divider ground structure coupled to the heat sink and having an inner flange surface and an inner cylindrical surface;

a power combiner ground structure coupled to the heat sink and having an inner flange surface and inner cylindrical surface defining, with the inner surfaces of the power divider ground structure, a chamber;

a plurality of angularly spaced apart power divider satellite conductors extending parallel to the first axis, radially spaced from the power divider center conductor and supported by the power divider ground structure;

an annular conductive ring having an axis coincident with the first axis and passing through the power divider satellite conductors;

a plurality of angularly spaced apart power combiner satellite conductors extending parallel to the second axis, radially spaced from the power combiner center conductor and supported by the power combiner ground structure;

an annular conductive ring having an axis coincident with the second axis and passing through the power combiner satellite conductors; and a plurality of connection bullets, the power divider satellite conductors being coupled to the power combiner satellite conductors with the connection bullets, the connection bullets being located interior of the apertures in the heat sink.

15. A power divider and combiner device in accordance with claim 14 and comprising a plurality of power transmission lines respectively defined, at least in part, by one of the apertures through the heat sink and one of the connection bullets.

16. A power divider and combiner device in accordance with claim 14 and further comprising a plurality of cooling fins thermally coupled to the power divider ground structure and the power combiner ground structure.

17. A power divider and combiner device in accordance with claim 14 wherein the heat sink comprises a plate.

18. A power divider and combiner device in accordance with claim 14 wherein the heat sink comprises a heat conductor plate, defining a plane perpendicular to the first and second axes, sandwiched between the power divider center conductor and the power combiner center conductor.

19. A power divider and combiner device in accordance with claim 14 and further comprising means for selectively receiving and retaining a gas.

20. A method in accordance with claim 10 wherein a first multiconductor transmission line is defined at least in part by the divider satellite conductors, the first center conductor portion, and the first portion exterior ground structure, wherein a second multiconductor transmission line is defined at least in part by the combiner satellite conductors, the second center conductor portion, and the second portion exterior ground structure, and wherein the electrical modeling comprises modeling the first and second multiconductor transmission lines to define at least part of the bandpass filter.

* * * * *